US005810182A

United States Patent [19]

Levin

[11] Patent Number: 5,810,182

[45] Date of Patent: Sep. 22, 1998

[54] ACCORDION DISPLAY EASEL

[76] Inventor: Samuel Levin, 1151 Sugar Creek Blvd., Sugar Land, Tex. 77478

[21] Appl. No.: 717,845

[22] Filed: Sep. 23, 1996

[51] Int. Cl.[6] ..... A47B 43/00

[52] U.S. Cl. ..... 211/195; 211/50

[58] Field of Search ..... 211/195, 50, 13.1, 211/174; 297/377, 380

[56] References Cited

U.S. PATENT DOCUMENTS

| | | | |
|---|---|---|---|
| 844,962 | 2/1907 | Sherlock | 211/195 |
| 1,480,286 | 1/1924 | Morganstern | 297/380 |
| 2,289,103 | 7/1942 | Cooper | 211/50 |
| 2,623,574 | 12/1952 | Damsch | 297/380 |
| 2,834,032 | 5/1958 | Scott | 297/377 |
| 2,973,888 | 3/1961 | Beardsley | 297/380 |
| 3,294,251 | 12/1966 | Howell | 211/195 |
| 3,342,294 | 9/1967 | Beatty | 297/377 |
| 3,719,284 | 3/1973 | Rasmusson et al. | 211/50 |
| 3,766,864 | 10/1973 | Baker et al. | 211/195 X |
| 3,967,327 | 7/1976 | Severson | 211/195 X |
| 4,926,512 | 5/1990 | Coyle | 297/377 X |
| 4,951,993 | 8/1990 | Taboada | 296/136 |
| 5,632,390 | 5/1997 | Podergois | 211/195 |

*Primary Examiner*—Peter M. Cuomo
*Assistant Examiner*—Stephen Vu
*Attorney, Agent, or Firm*—Gunn & Associates, P.C.

[57] ABSTRACT

This invention relates to a device for displaying objects, and is more particularly directed toward an easel comprising one or more ridges upon which devices to be displayed are hung or propped. The easel is constructed of material such a card board, plastic, or similar material which can be scored and folded into the desired configuration. Construction materials and manufacturing steps are relatively inexpensive. Various methods are disclosed to prevent the easel from collapsing under the weight of the displayed objects. The easel is also suitable for displaying articles of varying size and shape. Furthermore, the easel can be easily disassembled for storage or shipping.

10 Claims, 3 Drawing Sheets

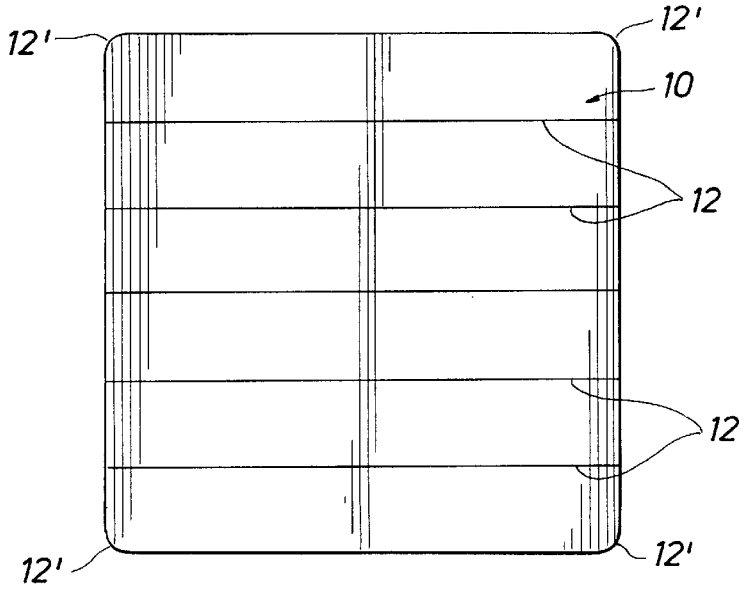
FIG. 1
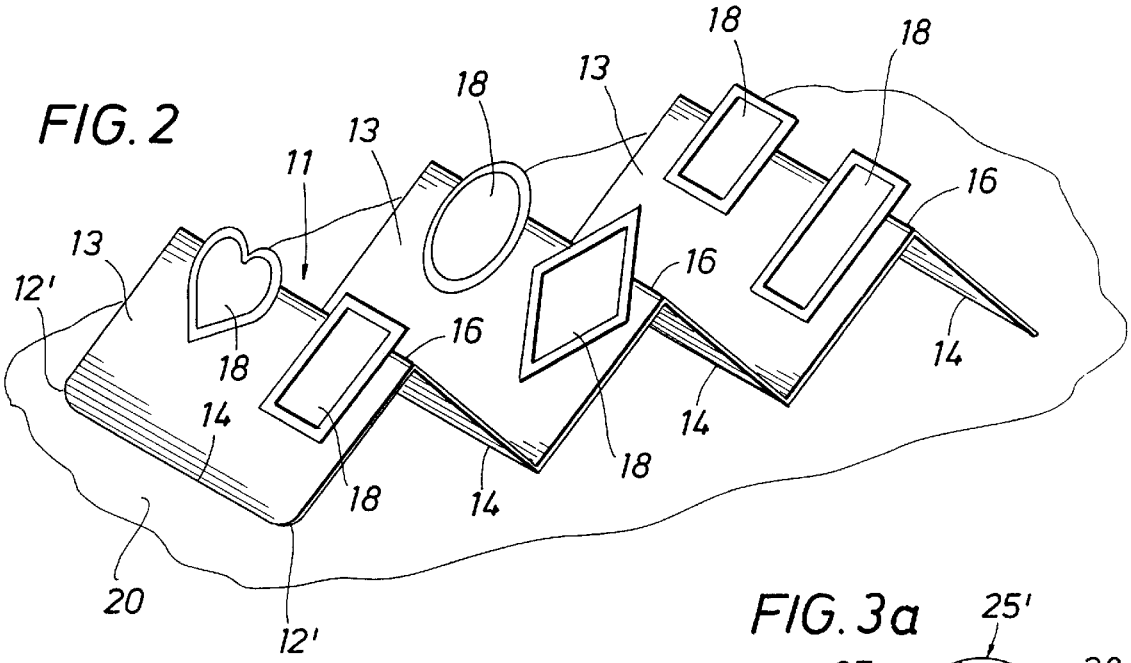
FIG. 2
FIG. 3a
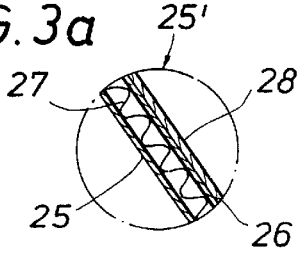
FIG. 3
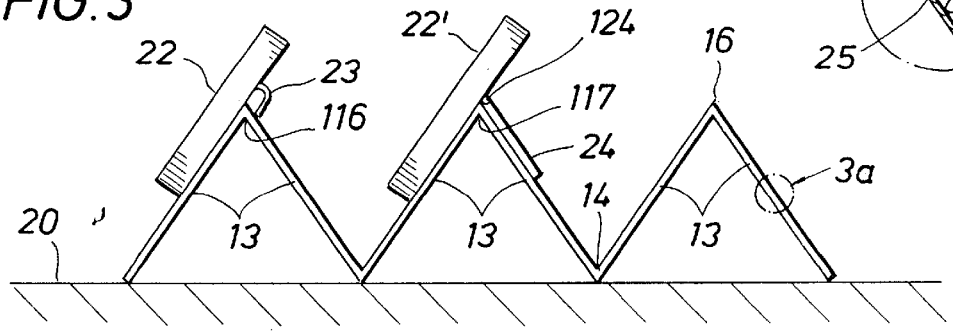

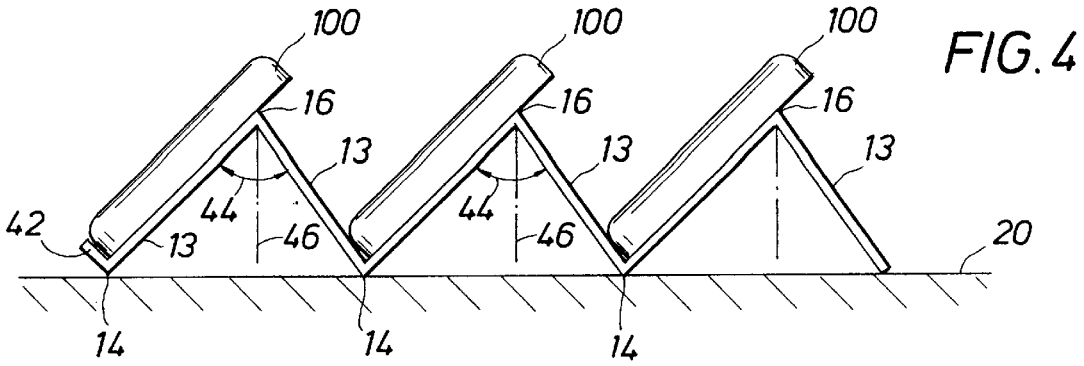
FIG. 4
FIG. 6a
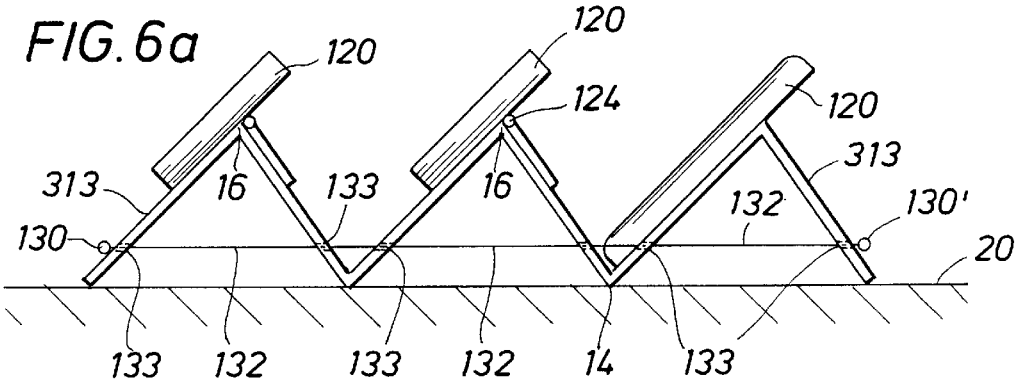
FIG. 5
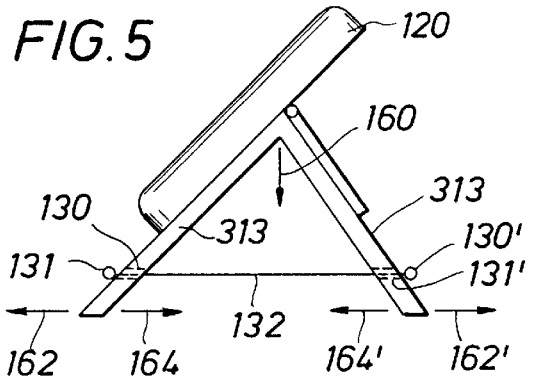
FIG. 6b
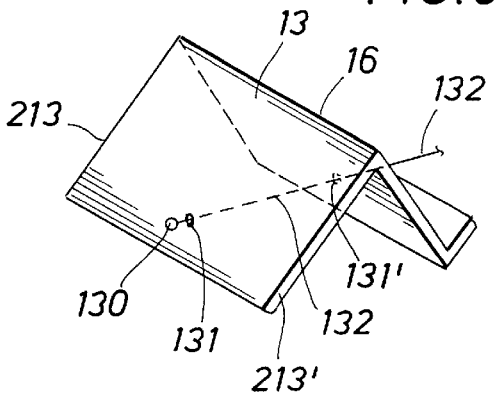
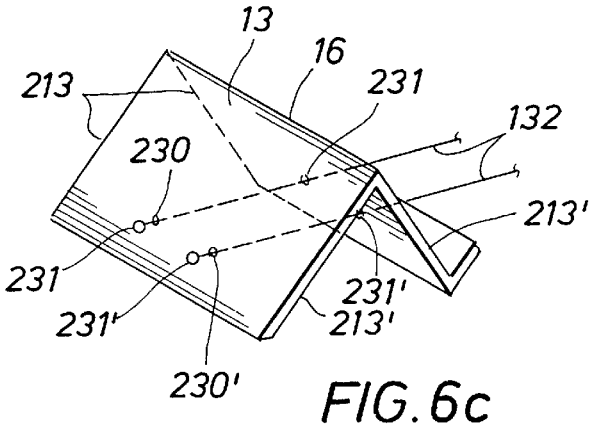
FIG. 6c
FIG. 8
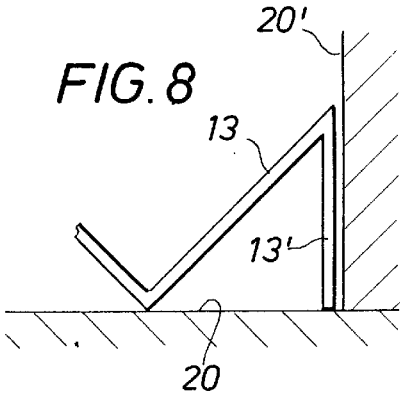

ACCORDION DISPLAY EASEL

BACKGROUND OF THE INVENTION

1. Field of the Invention

This invention relates to a device for displaying objects, and is more particularly directed toward an easel comprising one or more ridges upon which devices to be displayed are hung or propped.

2. Summary of Background Art

The method in which merchandise is displayed is an important factor in effectively selling the merchandise. In order to promote sales, merchandise should be displayed so that it can be easily viewed by prospective buyers. Furthermore, it is often desirable to display the products or merchandise in a manner in which the prospective buyer can readily grasp and examine the merchandise, and easily return the merchandise to the display fixture after examination.

Display space is an important factor in the economics of merchandising. Space requirement is usually a significant cost in merchandising. Products must be displayed efficiently in order to promote sales, yet display space must be minimized in order to reduce costs and therefore maximize profits. As an example, if the product being sold is picture frames, the frames must be displayed such that prospective customers can easily view and otherwise examine the frames, yet display "counter" space should be minimized so that a large number of frames can be displayed, or so that other merchandise can be displayed within the confines of available display space.

Display fixtures should provide the previously mentioned features of ease of view, ease of removal and replacement, and space efficiency. Display fixtures used in merchandising operations should also be relatively inexpensive to minimize merchandising costs and therefore maximize profits.

Numerous studies have shown that attractively displayed merchandise sells better than the same merchandise displayed in an aesthetically unattractive manner. Again, using picture frames as an example, frames orderly displayed on a physically attractive display device would be expected to sell more easily than the same picture frames displayed on a physically unattractive fixture.

It is highly desirable for merchandising display features to be versatile in that a variety of sizes and shapes of merchandise can be effectively displayed on a single type of display fixture. Stated another way, it is not economical to provide custom display fixtures for each shape and size of merchandise. Again using picture frames as an example, a single type or size of display fixture should be able to display a variety of sizes, shapes, weights and styles of picture frames.

An object of the invention is to provide a display fixture upon which merchandise can be place such that it can easily be viewed by prospective buyers.

An additional object of the present invention is to provide a display fixture from which merchandise can easily be removed for examination by prospective buyers, and easily replaced after examination.

A still further object of the present invention is to provide a display fixture upon which merchandise can be displayed in a space effective manner.

A further object of the present invention is to provide a display fixture which is inexpensive to purchase, and which can be easily assembled, easily disassembled, and easily shipped or otherwise transported.

One benefit of the present invention is to provide a display fixture which is physically attractive thereby promoting the sale of displayed merchandise.

Another feature is to provide a display fixture upon which merchandise of varying size, shape, type and weight can be displayed.

There are additional objects of the present invention which will become apparent in the following disclosure.

BRIEF SUMMARY OF THE INVENTION

The present disclosure is directed toward a display device, and more particularly directed toward an easel comprising one or more ridges upon which objects such as picture frames can be hung or propped for display.

The easel is made preferably of light weight, inexpensive, flat stock material such as card board, corrugated card board, plastic, or other similar material. For purposes of discussion, it will be assumed that the easel is made of corrugated card board stock material.

The easel is constructed from a piece of preferably rectangular card board which has been scored with a series of parallel lines which are not necessarily equally spaced. The card board is then folded at the scores in sequentially opposite directions thereby forming a series of adjacent, planar surfaces where one side of each surface terminates at a ridge edge and the opposite side of the surface terminates at a valley edge. Adjacent surfaces contact each other either at a ridge edge or at a valley edge and are normally slanting with respect to each other thereby forming a three dimensional "accordion" or "saw tooth" display fixture. The valley edges contact a common plane, which is usually a flat "counter" surface upon which the display easel is positioned. The heights of the ridge edges above the counter plane, and the angles between adjacent planar surfaces, can vary as will be discussed in a subsequent section. Objects to be displayed, such as picture frames, are either hung from the ridge edges of the easel, or propped against the slanting planar surfaces with the bottoms of the frames resting in the vicinity of the valley edges of the easel.

For purposes of discussion, assume that the display easel comprises more than one pair of adjacent planar surfaces therefore more than one ridge edge. Since the easel is made of a material such as card board, plastic, or the like, the folds forming the ridge and valley edges are somewhat resilient. When the easel is set up for display, the angle between planar surfaces is preferably the same for each pair of adjacent planar surfaces. Furthermore, the angle between planar surfaces is preferably bisected by a plane normal to the counter surface, and is usually within the range of 30 to 90 degrees. This angle can be selected depending upon requirements of displayed articles, and once selected, can be held fixed by means to be discussed in a subsequent section.

For purposes of storage, shipping or moving, the resilient score folds allows the easel to be "flattened" to the original planar, rectangular surface. In this geometry, all angles between adjacent planar surfaces are 180 degrees. Alternately, the easel can be "compressed" completely whereby the angles between adjacent planar surfaces are all zero degrees.

For aesthetic purposes, the easel material, which is card board for purposes of discussion, is preferably coated with a decorative coating of material such as plastic, paint, dye or other suitable material.

If the spacings of the previously discussed paralleled scores are equal and the angles between adjacent parallel surfaces are equal, then the heights of the ridges above the counter surface are essentially the same. If objects such as picture frames of differing size are to be displayed, it is advantageous to vary the heights of the ridge edges of the easel above the counter surface. This can be done either by varying the angles between adjacent surfaces, or by varying the distances between the fold scores. The latter approached is preferred as will be discussed subsequently. Furthermore, it is usually preferable to sequentially increase the heights of adjacent ridge edges, which is accomplished by sequentially increasing the distance between parallel fold scores.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of the invention and are therefore not to be considered limiting of its scope, for the invention may admit to other equally effective embodiments.

FIG. 1 shows a rectangular piece of stock which has been scored and from which an easel will be formed;

FIG. 2 shows a perspective view of a display easel upon which picture frames of varying sizes and shapes are displayed;

FIG. 3 is a cross sectional view of display easel illustrating the construction of the stock material, and also illustrating methods for displaying picture frames;

FIG. 4 Illustrates the prop method for displaying articles such as picture frames on an easel;

FIG. 5 illustrates the basic concepts of the stabilizing member to prevent an easel from collapsing under the load of a displayed article;

FIG. 6*a* shows an elastic cord stabilizing element for an easel containing three display ridges;

FIG. 6*b* illustrates the alignment of the elastic cord;

FIG. 6*c* closes the alignment of a stabilizing mechanism comprising two cords;

FIG. 8 illustrates a portion of a display easel designed to abut a vertical surface;

DETAILED DESCRIPTION OF THE PREFERRED EMBODIMENTS

Figure 7:
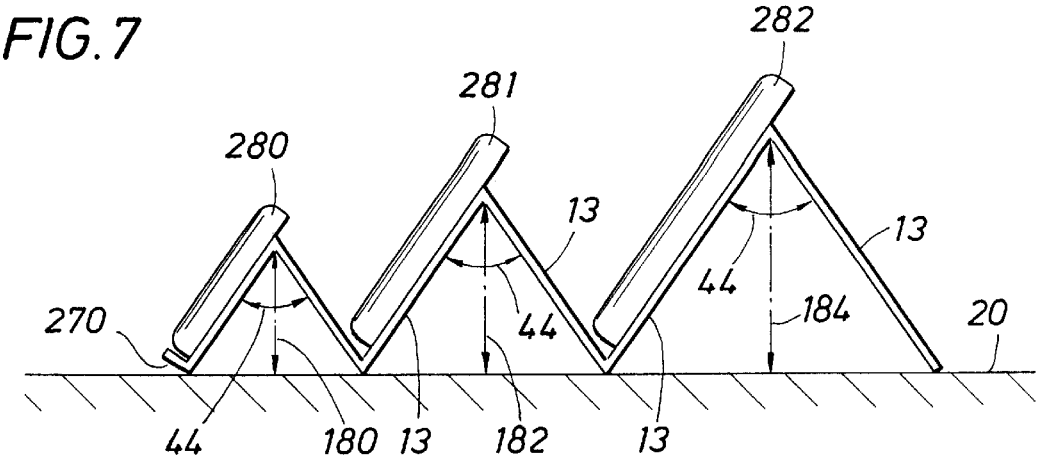
FIG. 7 illustrates an easel with ridges of varying height.

Attention is first directed to FIG. 1 which illustrates a rectangular piece 10 of stock material from which an "accordion" display easel is constructed. The stock material is preferably light weight, inexpensive, flat stock material such as card board, corrugated card board, plastic, or other similar material. The stock piece 10 is scored with at least one, but preferably with a plurality of parallel score lines 12. The stock is then folded or bent at the score lines 12 in sequentially opposite directions thereby yielding an accordion display easel shown in the perspective illustration of FIG. 2 and indicated in general by the numeral 11.

Again referring to FIG. 2, the easel 11 displays of a series of planar surfaces 13. Pairs of adjacent planar surfaces join to form either a ridge edge 16 or a valley edge 14. These ridge and valley edges are formed by the folded scores 12 in the stock 10 as previously described. The easel 11 is shown positioned such that the valley edges 14 contact a common planar or "counter" surface 20. The display easel 11 can be thought of a three dimensional surface of stock material shaped in the form of a bellows or an "accordion". The easel 11 comprises a minimum of one ridge edge 16 and two valley edges 14, but it should be understood that the easel preferably comprises two, three or even more ridge edges 16 with a corresponding number of valley edges to produce a stable fixture as shown in FIG. 2. It is readily apparent that the easel shown in FIG. 2 comprises three ridge edges 16 and four valley edges 14. The corners 12' of the front or terminus panel can be rounded as shown for decorative purposes, as can the corresponding corners of the back terminus panel.

The easel 11 can be used to display numerous articles of art, supplies, merchandise and the like. The displayed articles are positioned on the accordioned planar surfaces 13 of the easel 11. Referring again to FIG. 2, picture frames 18 of varying size and shape are shown displayed on the three-ridge easel 11. Referring also to FIG. 3, which shows a side view of the easel 11, if a first picture frame 22 contains a hanging hook 23, the hook 23 can be rested upon the ridge edge 116 thereby supporting the frame 22 on the easel for display. A second picture frame 22' is shown which is designed to rest upon a table top by means of a prop 24 hinged to the back of the frame 22'. The picture frame 22' can be supported on the easel 11 by positioning the hinge joint of the prop 24 and the back of the frame 22' on the ridge edge 117. There are additional means for supporting picture frames for display as will be disclosed in subsequent sections.

For aesthetic purposes, the easel stock material 10, which will be assumed to be corrugated card board for purposes of discussion, is preferably coated with a decorative coating of material such as plastic, paint, dye or other suitable material. Again referring to FIG. 3, the enlarged sectional view 25' depicts details of the easel stock 10. The core stock comprises the surfaces 25 and 26 which are separated by the corrugation 27. The decorative coating 28 is applied to the stock surface 26. For the easel depicted in FIG. 3, the stock surface 26 is the more visible stock surface and is, therefore, the surface to which the decorative coating 28 is applied. It should be understood, however, that a second decorative coating (not shown) could also be applied to the stock surface 25.

If the scores 12 of the stock material are of equal depth, the folding of the stock would be expected to produce a symmetrical easel as shown in cross section in FIG. 4. When the easel 11 is set up for display on the counter surface 20, the angle 44 is essentially the same for each pair of adjacent planar surfaces 13. Adjacent pairs of panel surfaces will sometimes be referred to as "accordion folds". Furthermore, the angle 44 between planar surfaces 13 is preferably bisected by a plane 46 (shown in side view) which is normal to the counter surface 20. For typical stock materials and score depths, the angle 44 usually falls within the range of 30 to 90 degrees. This angle can be selected depending upon requirements of displayed articles, and once selected, can be held fixed by means to be discussed in a subsequent section.

FIG. 4 also illustrates a second method for displaying picture frames 100 on the easel 11. Using this method, the frames are not hung from the ridge edges 16 as in the previously discussed manner, but are propped against the slanting planar surfaces 13. That is, the base each frame 100 rests on the easel in the vicinity of a valley edge 14, and the back of the frame contacts the slanting planar surface 13. The lip 42 used to support one of the frames will be discussed in a subsequent section.

Using either the method of display shown in FIG. 3 or the method of display shown in FIG. 4, the weight of the displayed objects, which for purposes of discussion are picture frames, exerts a downward force component normal to the counter surface 20. This is shown in FIG. 5 where a picture frame 120 is hung from the ridge edge 16. The weight of the frame 120 exerts a downward force which is represented by the vector 160. Since the ridge edge 16 is not rigid but hinges about the score 12 (see FIG. 1), the force vector 160 causes reactive lateral forces represented by the vectors 162 and 162'. These force vectors tend to "spread" the valley edges 14 or the slanting planar surfaces 13. This, in turn, tends to collapse the easel. To prevent the spreading of the surfaces 13 and the eventual collapse of the easel under the weight of the frame 120, a stabilization member 132 is employed. The stabilization member can be a string, wire or rod but is preferably an elastic cord, hereafter referred to as a restraining cord. The restraining cord 132 passes through, or is "threaded" through, preferably aligned holes 131 and 131' in the planar surfaces 13. Retention elements 130 and 130', such as nuts or knots which will not pass through the holes 131 and 131' in the end or "terminus" panels 313, are affixed to the ends of the restraining cord 132 to retain the restraining cord as shown in FIG. 5. The elasticity of the restraining cord 132, combined with the knots 130 and 130' contacting the surfaces 313, provide equal and opposing forces to prevent the surfaces 313 from spreading and collapsing under the weight of the frame 120. Stated vectorially, a force represented by the vector 164 is equal and opposite to the force vector 162, and a force represented by the vector 164' is equal and opposite to the force vector 162'.

Features of the restraining cord are further illustrated in FIGS. 6*a*, 6*b*, and 6*c*. It is preferable to thread the restraining cord 132 through the planar surfaces near the valley edges rather than the ridge edges as shown in FIG. 6*a*. Furthermore, it is preferable to center the restraining cord 132 and further align the holes 131 and 131' in each panel 13 such that the holes are equidistant from the panel edges 213 and 213' as shown in FIG. 6*b*. In another embodiment, a double restraining cord is used as illustrated in FIG. 6*c*. The cord is threaded through pairs of holes in each panel 13, where the distances between the holes 230 and 231 and the edge 213 are equal to the distances between the holes 230' and 231' and the edge 213' of each panel 13.

A fixed stabilizing member can be used to adjust and fix the angles between adjacent panels. If an elastic stabilizing member is used, the angles between adjacent panels can vary depending upon the magnitude of the force vector 160 (see FIG. 5). Stated another way, as the weight of the frame increases, the spreading of the valley edges increases, and the elastic retainer cord 132 is stretched until the reactive vector forces 164, 164' are equal and opposite to the spreading vector forces 162,162', respectively.

In previous illustrations, the distances between parallel scores 12 (see FIG. 1) have been assumed to be equal. Further, assuming that the angles 44 (see FIG. 4) between the planar surfaces 13 are equal, then the heights of the ridges 16 above the counter surface 20 are essentially the same. If objects such as picture frames of differing size are to be displayed, it is advantageous to vary the heights of the ridge edges 16 of the easel above the counter surface 20. This can be done either by varying the angle 44 between adjacent planar surfaces 13, or by varying the distances between the fold scores 12. The latter approached is preferred as will be discussed subsequently. Furthermore, the latter method is usually preferable in order to sequentially increase the heights of adjacent ridge edges, as illustrated in FIG. 7. By sequentially increasing the distance between parallel fold scores in moving from right to left in FIG. 7, and by keeping the angles 44 between the panels 13 essentially equal, the height 182 of a second ridge edge is greater than the height 180 of a first ridge edge. Furthermore, the height 184 of a third ridge edge is greater than the height 182 of the second ridge edge. FIG. 7 also illustrates a lip 270 affixed to the valley edge of the left most planar panel 13 of the easel. The lip is preferably normal to this planar surface 13. When picture frames are displayed using the "prop" method (discussed previously) as illustrated in FIG. 7, the lip 270 allows a frame 280 to be displayed on the first accordion fold of the easel. Since the ridge edge heights increase in moving from right to left in FIG. 7, progressively larger frames 281 and 282 can be effectively displayed and viewed from the front of the easel with minimal view blockage.

In all previous illustrations, it should be understood that a plurality of frames can be displayed on a single accordion fold of the easel as shown in FIG. 1. It might, however, be necessary to position frames such that they do not interfere with any restraining cord or cords used to prevent easel collapsing.

Some display applications require that the easel abut a vertical wall 20', which is perpendicular to the counter surface 20 and which is illustrated, in FIG. 8. For this requirement, the score forming the ridge edge of the abutting accordion fold can be folded such that the planar panel 13' is vertical.

Figure 9:
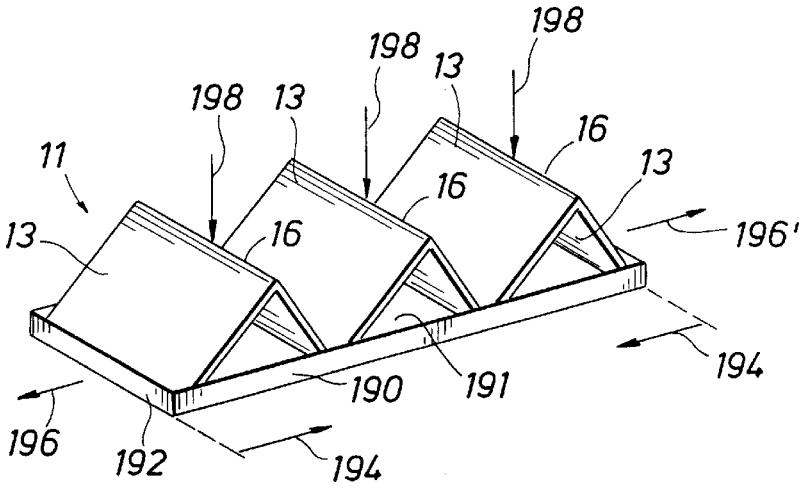
FIG. 9 illustrates a tray method for preventing an easel from collapsing under the load of displayed objects.

FIG. 7 illustrates an alternate embodiment of the easel 11 where a tray is used instead of a restraining cord to prevent the easel from collapsing. The tray comprises a base 191 and parallel and preferably vertical sides 190 (one side shown), and parallel and preferably vertical sides 192 (one side shown). In practice, the tray could be the top of a box in which one or more easels are shipped. Forces represented by the vectors 198 and applied to the ridge edges 16 by the weights of the displayed frames (not shown) are again transferred to horizontal forces represented by the essentially equal and opposite vectors 196 and 196'. These forces tent to collapse the easel 11, however the tray edges 192 counteract these forces with equal and opposite forces. For purposes of preventing collapsing of the easel 11, only the edges 192 are required, although the edges 190 assist in keeping the accordion folds of the easel aligned. The front edge 192 shown in FIG. 9 can also be used as a substitute for the previously discussed lip 270 which is shown in FIG. 7.

To conserve space in shipping and storing, the easel 11 can either collapsed such that it is configured as shown in FIG. 1 with the angles 44 between adjacent planar surface panels 13 being 180 degrees. Alternately, the easel can be fully "compressed" such that the angles 44 between adjacent panels 13 are zero degrees.

Figure 10:
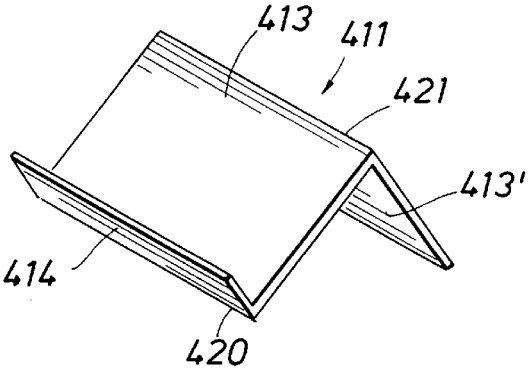
FIG. 10 depicts a display easel constructed from performed subsections.
Figure 10A:
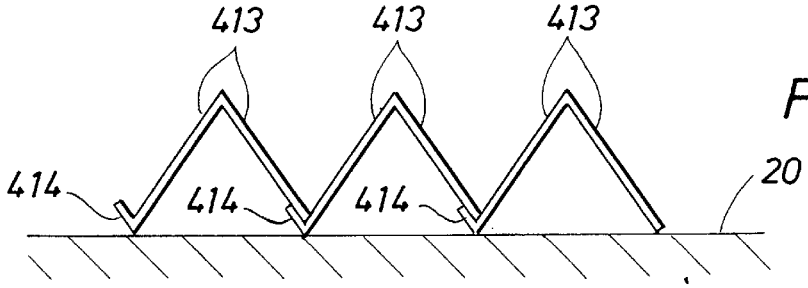

A display easel can be formed from a plurality of scored and folded stock subsections. Such a subsection is shown in FIG. 10 and identified by the numeral 411. A stock section is scored and folded at locations designated by the numerals 420 and 421 thereby forming planar panels 413 and 413' which intersect at a ridge 421. An abbreviated overlap planar panel 414 is also formed. The planes of panel 413' and abbreviated panel 414 are parallel. The display easel is formed by interlocking or "stacking" on the counter surface 20 subsections as shown also in cross sectional view in FIG. 10. Subsections can be easily added or subtracted depending upon the demands of the display.

While the foregoing is directed to the preferred embodiment of the invention, the scope thereof is determined by the claims which follow.

What is claimed is:

1. A display easel comprising an arrangement of three pairs of planar panels wherein:

(a) each said pair comprising (i) first and second planar panels, each said panel having an upper edge and a lower edge, (ii) a ridge edge formed by the intersection of two upper edges, wherein said intersection forms an inverted V-shaped flexible joint;

(b) a stabilizing member comprising (i) an elastic cord comprising a first end and a second end, and (ii) first and second retention elements, wherein said elastic cord is threaded through each of said planar panels and is affixed to one of the planar panels of the first pair by said first retention element and said second end of said elastic cord is affixed to one of the planar panels of the third pair by said second retention element;

(c) two valley edges are formed by the intersection of the lower edges of the planar panels between said three pairs; and, (d) a tray comprising a rectangular base and four edges which are essentially normal to the plane of said base and wherein two opposing tray edges abut said valley edges to prevent said valley edges from spreading and thereby collapsing said easel.

2. The display easel of claim 1, wherein (a) one of said planar panels of the first pair comprises a lip surface at the lower edge; and (b) said lip is essentially normal to the plane of said planar panel.

3. The display easel of claim 1, wherein the angle between said intersecting planar panels forming said ridge edge for each of said three pairs is equal.

4. The display easel of claim 3, wherein said display easel is flattened for storage by making said angles equal to 180 degrees.

5. The display easel of claim 3, wherein said display easel is compressed for storage by making said angles zero degrees.

6. The display easel of claim 1, wherein one said terminus panel is vertical with respect to a surface upon which said easel rests.

7. A display easel comprising:

(a) a tray having a rectangular base with four edges defining said base, wherein said edges are normal to the plane of said base and wherein two of the four edges are spaced by a specified distance;

(b) at least one pair comprising:

(i) first and second planar panels, each said panel having an upper edge and a lower edge, (ii) a ridge edge formed by the intersection of two upper edges, wherein said intersection forms an inverted V-shaped flexible joint;

(c) two valley edges are formed by the intersection of the lower edges of the planar panels between said pair with two other pairs, (d) a stabilizing member which cooperates with said planar panels to prevent said valley edges from spreading such that said easel collapses.

8. The display easel of claim 1, wherein;

(a) said planar panels are made of flexible material; and (b) said ridge edge comprises a flexible joint scoring and bending said flexible material.

9. The display easel of claim 8, wherein said flexible material is a flexible card board.

10. The display easel of claim 8, wherein at least one side of said flexible material is coated with a decorative coating.

* * * * *